US008915559B2

(12) United States Patent
Kinlaw et al.

(10) Patent No.: US 8,915,559 B2
(45) Date of Patent: Dec. 23, 2014

(54) HOUSEHOLD APPLIANCE INCLUDING FORCE DISTRIBUTOR

(75) Inventors: Louis Kinlaw, Greenville, NC (US); Rob Ladner, Dryden, MI (US)

(73) Assignee: BSH Home Appliances Corporation, Irvine, CA (US)

( * ) Notice: Subject to any disclaimer, the term of this patent is extended or adjusted under 35 U.S.C. 154(b) by 0 days.

(21) Appl. No.: 13/305,781

(22) Filed: Nov. 29, 2011

(65) Prior Publication Data

US 2013/0134847 A1 May 30, 2013

(51) Int. Cl.
*A47B 77/06* (2006.01)

(52) U.S. Cl.
USPC ..... 312/228; 206/592; 206/320

(58) Field of Classification Search
USPC ..... 206/521, 523, 586, 587, 591, 592, 320; 312/228, 352, 351.1; 108/51.11
See application file for complete search history.

(56) References Cited

U.S. PATENT DOCUMENTS

| | | | | |
|---|---|---|---|---|
| 3,049,260 | A * | 8/1962 | Stone | 217/53 |
| 4,951,821 | A | 8/1990 | Kempkes | |
| 5,249,678 | A * | 10/1993 | Traina | 206/320 |
| 5,431,336 | A * | 7/1995 | Clee | 229/199 |
| 5,772,037 | A | 6/1998 | Hurley | |
| 6,103,335 | A * | 8/2000 | Zoller et al. | 428/116 |
| 6,234,314 | B1 | 5/2001 | Qiu et al. | |
| 6,286,683 | B1 | 9/2001 | Hunt | |
| 6,368,694 | B1 * | 4/2002 | Marsh et al. | 428/99 |
| 6,595,367 | B2 | 7/2003 | Baechle | |
| 6,634,613 | B1 * | 10/2003 | Kaper et al. | 248/346.01 |
| 6,881,469 | B2 | 4/2005 | Hightower | |
| 7,216,765 | B2 | 5/2007 | Markert et al. | |
| 7,258,319 | B2 * | 8/2007 | Johanson et al. | 248/346.02 |
| 7,264,863 | B2 | 9/2007 | Haymond | |
| 7,320,403 | B2 | 1/2008 | May, Jr. | |
| 7,325,500 | B2 | 2/2008 | Carpenter et al. | |
| 2008/0131225 | A1 | 6/2008 | Payne | |

* cited by examiner

*Primary Examiner* — Daniel Rohroff
(74) *Attorney, Agent, or Firm* — James E. Howard; Andre Pallapies

(57) ABSTRACT

A household appliance including a cabinet having a frame and one or more force distributors structured to absorb forces that the cabinet receives during shipping and handling. The one or more force distributors may include a block portion having cut-out sections throughout that lead to a generally flat planar bottom portion. To reduce material costs, the cut-out sections may include a surface area of greater than fifty percent of the total surface area of the one or more force distributors. The invention also includes a method for attaching the one or more force distributors to the household appliance.

15 Claims, 7 Drawing Sheets

HOUSEHOLD APPLIANCE INCLUDING FORCE DISTRIBUTOR

BACKGROUND OF THE INVENTION

1. Field of the Invention

The present invention relates to a household appliance and more particularly, to a household appliance including one or more force distributors and a method thereof that is used to absorb forces during shipping and handling of the dishwasher.

2. Related Art

In the related art, household appliances, such as dishwashers, include mechanisms such as packaging and force distributors that are used to protect the household appliance during shipping and handling. However, in the related art, the force distributors often require the use of screws to attach them to the dishwasher. Further, the force distributors are often costly to produce, in part due to material costs.

The present invention introduces a household appliance with one of more force distributors that use up to fifty percent less material than related art force distributors and also eliminate the need for attachment screws. In exemplary embodiments of the invention, the force distributors use snap-fit mechanisms as well as press-fit mechanisms to attach the force distributors to a frame of the dishwasher.

SUMMARY OF THE INVENTION

A first aspect of the present invention is directed to a household appliance. The household appliance may include a cabinet having a frame and one or more force distributors structured to absorb forces that the cabinet receives during shipping and handling. The one or more force distributors may include a block portion having cut-out sections throughout that lead to a generally flat planar bottom portion. To reduce material costs, the cut-out sections may include a surface area of greater than fifty percent of the total surface area of the one or more force distributors.

A second aspect of the present invention is directed to a method for absorbing forces that a cabinet of a household appliance receives during shipping and handling. The method may include attaching one or more force distributors to a frame of the household appliance, the one or more force distributors including a block portion having cut-out sections throughout that lead to a generally flat planar bottom portion. Further, the one or more force distributors may be formed from injection molding.

The illustrative aspects of the present invention are designed to solve the problems herein described and other problems not discussed.

BRIEF DESCRIPTION OF THE DRAWINGS

These and other features of this disclosure will be more readily understood from the following detailed description of the various aspects of the disclosure taken in conjunction with the accompanying drawings that depict various exemplary embodiments of the disclosure, in which.

Figure 1:
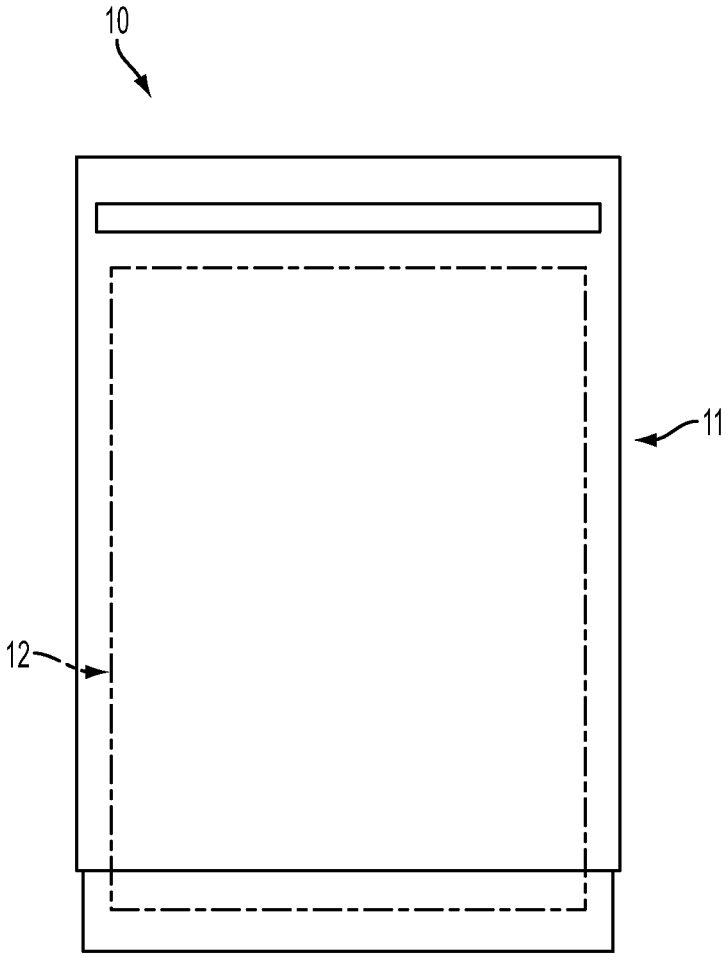
FIG. 1 depicts a household appliance including a frame according to an exemplary embodiment of the invention.

The drawings are merely schematic representations, not intended to portray specific parameters of the invention. The drawings are intended to depict only typical embodiments of the invention, and therefore should not be considered as limiting the scope of the invention. In the drawings, like numbering represents like elements.

DETAILED DESCRIPTION OF THE INVENTION

FIG. 1 shows an exemplary embodiment of a household appliance of the present invention, such as a dishwasher 10. The dishwasher 10 may comprise a door 11 which is suitable for tiltable opening. The dishwasher may further include a frame 12 to which the door is attached and which provides for structural integrity of the dishwasher 10.

While exemplary embodiments of force distributors are described below, it should be understood that the invention is not limited to these embodiments and it is envisioned that multiple configurations of the force distributors may be used that are formed by injection molding to include up to fifty percent less material and also eliminate the need for attachment screws, for example, by using snap-fit mechanisms as well as press-fit mechanisms to attach the force distributors to a frame of the dishwasher 1.

Figure 2:
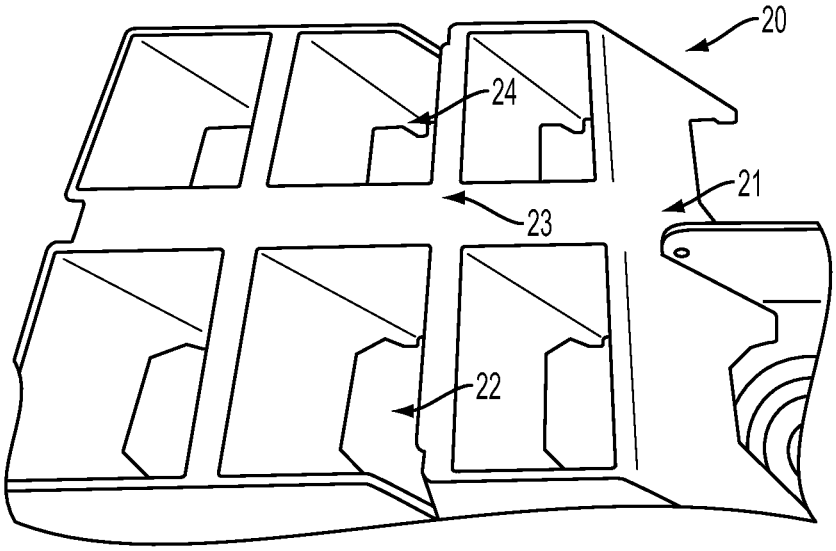
FIG. 2 depicts a force distributor structured to absorb forces that a cabinet of the household appliance receives during shipping and handling.

FIG. 2 depicts an exemplary embodiment of a force distributor 20 structured to absorb forces that the cabinet receives during shipping and handling. The force distributor 20 may be attached to the frame 12 and may include a block portion 21 having cut-out sections 22 throughout that lead to a generally flat planar bottom portion 23. In FIG. 2, the force distributor 20 may include a snap-fit mechanism 24, such as a hook mechanism to attach to the frame 12.

Figure 3:
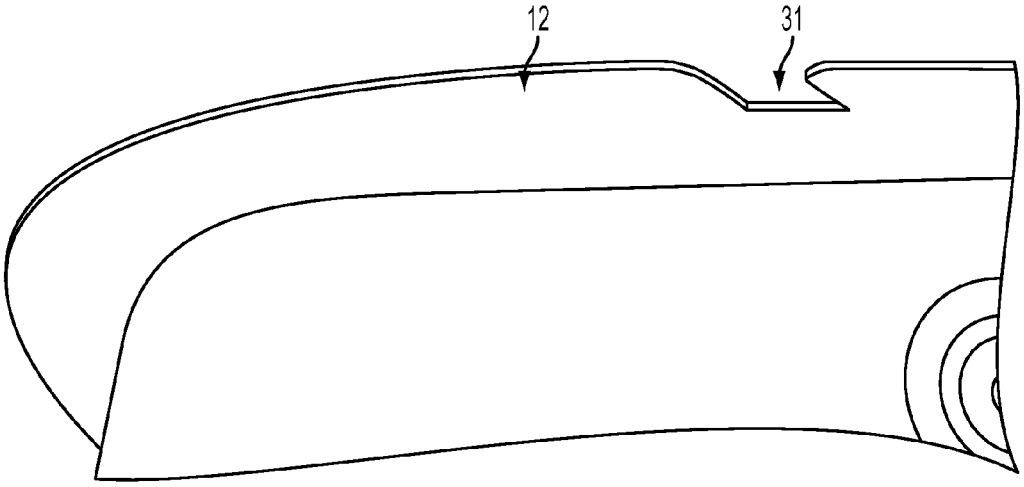
FIG. 3 depicts a front portion of the frame including a cut-out section to which the force distributor is attached according to an exemplary embodiment of the invention.

FIG. 3 depicts a front portion of the frame 12 including a cut-out section 31 to which the force distributor 20 is attached. In the embodiment of FIG. 3, the force distributor 20 may be attached at a front corner of the frame 12.

Figure 4:
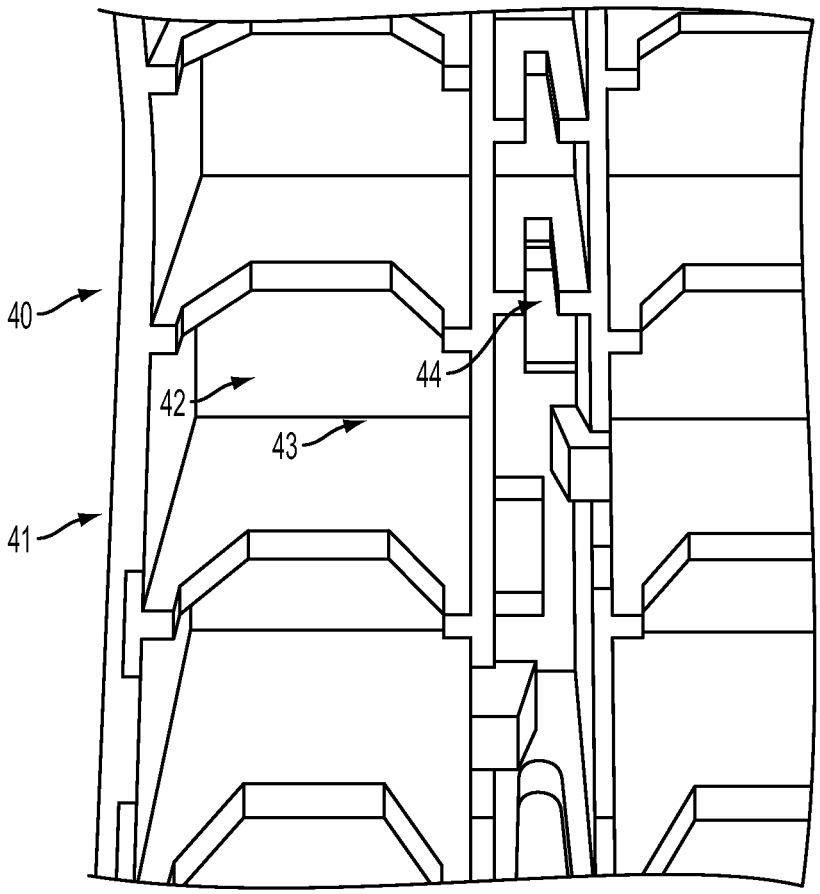
FIG. 4 depicts a second embodiment of a force distributor of the invention structured to absorb forces that the cabinet receives during shipping and handling.

FIG. 4 depicts a second exemplary embodiment of a force distributor 40 structured to absorb forces that the cabinet receives during shipping and handling. Like force distributor 20, force distributor 40 may be attached to the frame 12 and include a block portion 41 having cut-out sections 42 throughout that lead to a generally flat planar bottom portion 43. In FIG. 4, the force distributor 40 may include a press-fit mechanism 44 to attach to the frame 12.

Figure 5:
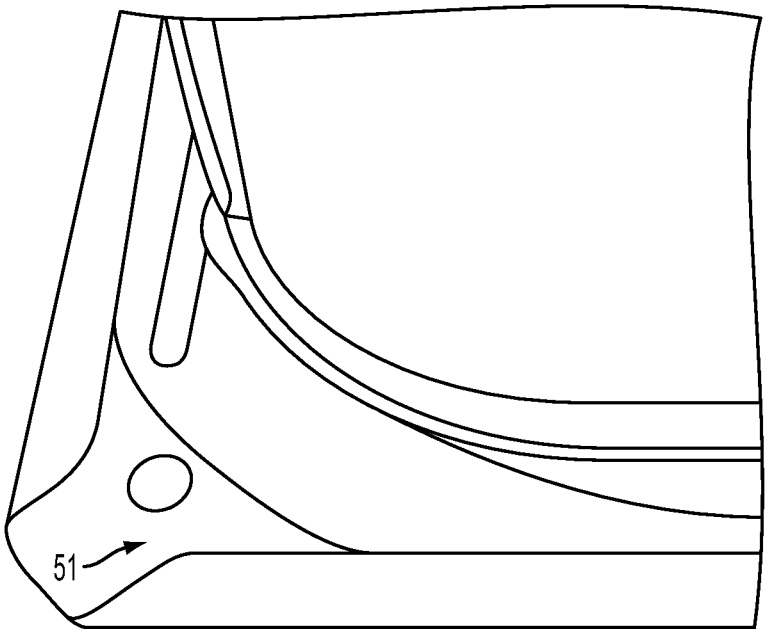
FIG. 5 depicts a rear portion of the frame including a cut-out section to which the second embodiment of the force distributor is attached.

FIG. 5 depicts a portion of the frame 12 including a cut-out section 51 to which the force distributor 40 is attached. In the embodiment of FIG. 5, the force distributor 40 may be attached at a rear corner of the frame 12.

The force distributors 20, 40 may be formed by injection molding from a thermoplastic material known in the art such as at least one of polystyrene, polyethylene, polypropylene, nylon, high impact polystyrene and acrylonitrile butadiene styrene (ABS).

Figure 6:
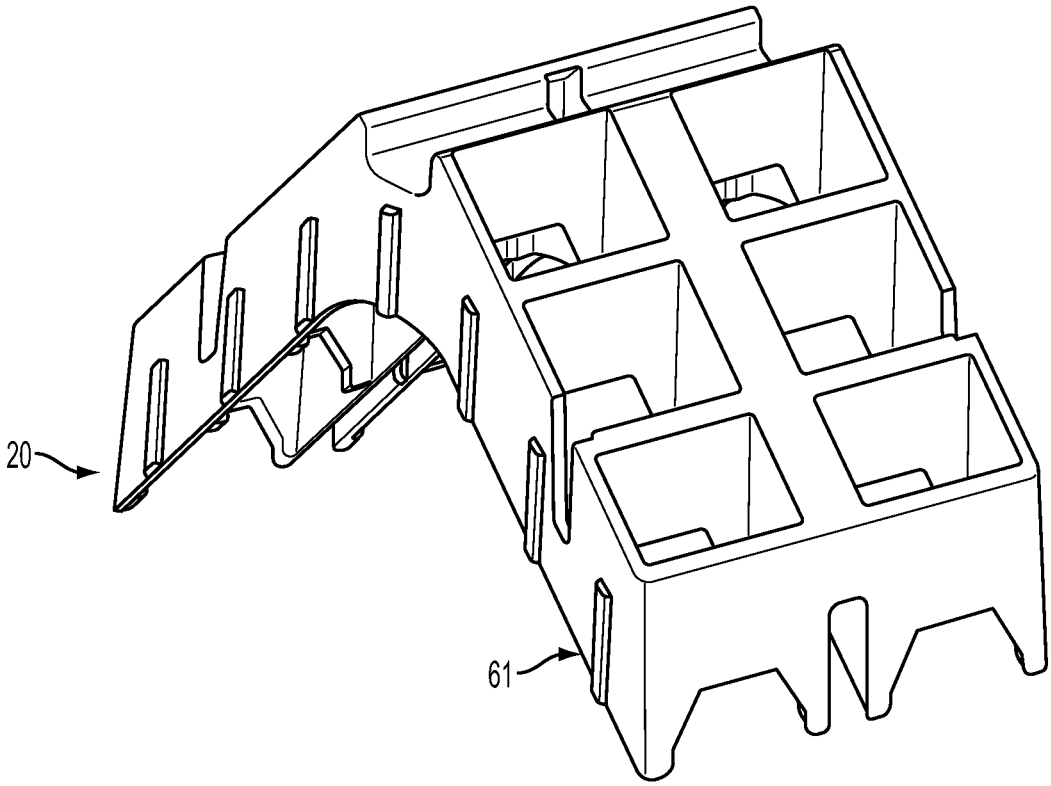
FIG. 6 depicts the force distributor of FIG. 2 formed in an approximate L-shape to attach to corners of the frame.

FIG. 6 depicts the force distributor 20 formed in an approximate L-shape to attach to corners of the frame 12. As shown in FIG. 6, the force distributor 20 may include ribs 61 on a side portion thereof to reinforce a stability of the force distributor 20.

Figure 7:
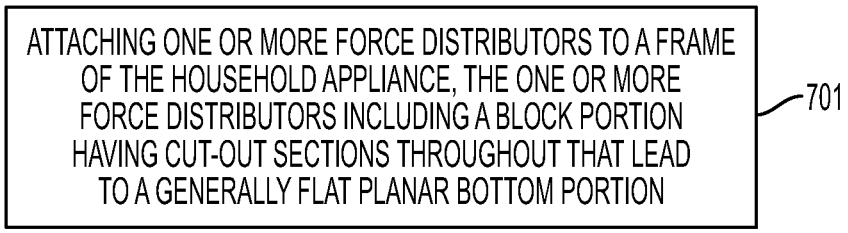
FIG. 7 depicts an exemplary method of the invention for absorbing forces that a cabinet of a household appliance receives during shipping and handling.

FIG. 7 depicts an exemplary method of the invention for absorbing forces that a cabinet of a household appliance receives during shipping and handling. The method includes at step 701, attaching one or more force distributors to a frame of the household appliance, the one or more force distributors including a block portion having cut-out sections throughout that lead to a generally flat planar bottom portion. In an exemplary method, the one or more force distributors may be formed from injection molding.

While only certain features of the invention have been illustrated and described herein, many modifications and changes will occur to those skilled in the art. It is, therefore, to be understood that the appended claims are intended to cover all such modifications and changes as fall within the true spirit of the invention.

What is claimed is:

1. A household appliance, comprising:

a cabinet including a frame having at least one frame cut-out section, the at least one frame cut-out section formed from removing two, adjacent sides of the frame that form a corner of the frame to expose a flat planar bottom portion of the frame; and one or more force distributors structured to absorb forces that the cabinet receives during shipping and handling, the one or more force distributors attaching to the at least one frame cut-out section of the frame and including a block portion having block cut-out sections, the block portion at least partially insertable into at the least one frame cut-out section, wherein the block cut-out sections include a surface area of greater than fifty percent of the total surface area of the one or more force distributors, and wherein the one or more force distributors include ribs on at least one exterior wall of the continuous side portions thereof to reinforce a stability of the one or more force distributors.

2. The household appliance according to claim 1, wherein a first of the one or more force distributors include a snap-fit mechanism to attach to the frame cut-out section of the frame.

3. The household appliance according to claim 2, wherein the snap-fit mechanism is a hook mechanism.

4. The household appliance according to claim 2, wherein a first force distributor is attached at a front corner of the frame.

5. The household appliance according to claim 1, wherein a first of the one or more force distributors includes a press-fit mechanism to attach to the frame cut-out section of the frame.

6. The household appliance according to claim 5, wherein the first force distributor is disposed at a rear corner of the frame.

7. The household appliance according to claim 1, wherein the one or more force distributors is formed from a thermoplastic material.

8. The household appliance according to claim 7, wherein the thermoplastic material is one of polystyrene, polyethylene, polypropylene, nylon, high impact polystyrene and acrylonitrile butadiene styrene (ABS).

9. The household appliance according to claim 1, wherein the block cut-out sections are formed by injection molding.

10. The household appliance according to claim 1, wherein the one or more force distributors are formed in an L-shape.

11. A method for absorbing forces that a cabinet of a household appliance receives during shipping and handling, the method comprising the step of:

attaching one or more force distributors to a frame cut-out section of a frame of the household appliance, the at least one frame cut-out section formed from removing two, adjacent sides of the frame that form a corner of the frame to expose a flat planar bottom portion of the frame; the one or more force distributors including a block portion having block cut-out sections, the block portion at least partially insertable into the frame cut-out section, wherein the block cut-out sections are formed during injection molding to include a surface area of greater than fifty percent of the total surface area of the one or more force distributors, and wherein the one or more force distributors include ribs on an exterior wall of the continuous side portions thereof to reinforce a stability of the one or more force distributors.

12. The method for absorbing forces that a cabinet of a household appliance receives during shipping and handling according to claim 11, further comprising forming the one or more force distributors from injection molding.

13. The method for absorbing forces that a cabinet of a household appliance receives during shipping and handling according to claim 11, wherein a first of the one or more force distributors is snap-fit to attach to the frame cut-out section of the frame.

14. The method for absorbing forces that a cabinet of a household appliance receives during shipping and handling according to claim 11, wherein a first of the one or more force distributors is press-fit to attach to the frame cut-out section of the frame.

15. The method for absorbing forces that a cabinet of a household appliance receives during shipping and handling according to claim 11, wherein during injection molding, the one or more force distributors are molded to include ribs on a side portion thereof to reinforce a stability of the one or more force distributors.

* * * * *